US005365636A

United States Patent [19]

Jensen

[11] Patent Number: 5,365,636

[45] Date of Patent: Nov. 22, 1994

[54] APPARATUS FOR CLOSING SLIDING DOORS

[76] Inventor: James N. Jensen, 4127 W. Danbury Dr., Glendale, Ariz. 85308

[21] Appl. No.: 143,995

[22] Filed: Oct. 27, 1993

Related U.S. Application Data

[63] Continuation of Ser. No. 776,219, Oct. 15, 1991, abandoned.

[51] Int. Cl.[5] ..... E05F 3/00

[52] U.S. Cl. ..... 16/67; 16/72

[58] Field of Search ..... 16/72, 78, 66, 67, 63

[56] References Cited

U.S. PATENT DOCUMENTS

| | | | |
|---|---|---|---|
| 141,896 | 8/1873 | Shaw | 16/67 |
| D. 273,457 | 4/1984 | Matsuo et al. | D8/330 |
| D. 296,758 | 7/1988 | Ogawa et al. | D8/330 |
| 828,063 | 8/1906 | Sinz | 16/67 |
| 3,389,422 | 6/1968 | Glenn | 16/78 |
| 4,301,623 | 11/1981 | Demukai | 16/82 |
| 4,642,845 | 2/1987 | Marshik | 16/DIG. 16 |
| 4,854,554 | 8/1989 | Ludwig | 16/66 |
| 4,884,369 | 12/1989 | Tatham | 49/404 |
| 5,131,188 | 7/1992 | Hutchison et al. | 16/72 |

OTHER PUBLICATIONS

Gas Spring Company Division of Fichtel & Sachs Industries, Inc. advertising brochure.

Glidestar Industries advertising brochure.

*Primary Examiner*—Kurt Rowan

*Assistant Examiner*—Chuck Y. Mah

*Attorney, Agent, or Firm*—Cahill, Sutton & Thomas

[57] ABSTRACT

A sliding door closer for automatically returning a sliding door to a closed position includes a gas spring having a cylinder and a rod slidingly received thereby. Pressurized gas within the cylinder urges the rod to an extended position. A block and tackle pulley system is secured to the opposing ends of the gas spring for rotatably supporting a cable extending between the sliding door and the door jamb. The gas spring rod is compressed as the door is opened. Extension of the gas spring rod causes the door to close when released. A piston secured to the gas spring rod has an orifice therein for causing the rod to extend at a controlled rate. The cylinder includes a quantity of oil to cushion the final extension of the rod to further slow the final closing of the door. The gas spring and pulley system fit compactly within the frame of the door or within a tubular housing secured to a side of the door.

19 Claims, 2 Drawing Sheets

APPARATUS FOR CLOSING SLIDING DOORS

This is a continuation of patent application Ser. No. 07/776,219 filed Oct. 15, 1991, by James N. Jensen, and entitled "APPARATUS FOR CLOSING SLIDING DOORS", now abandoned.

BACKGROUND OF THE INVENTION

1. Field of the Invention

The present invention relates generally to door closing mechanisms, and more particularly, to a mechanism for automatically closing a sliding door in a controlled, dampened fashion.

2. Description of the Prior Art

Sliding glass doors are often used in residential homes for providing access to patios and swimming pools. The large glass area provides a pleasant view of the outdoors while avoiding the need to allow additional space around the doorway for the doors to open inward or outward. Such doors are relatively heavy and are typically supported by rollers secured either to the upper end of the door or to the lower end of the door; such rollers ride along a track for allowing the door to slide back and forth. However, such doors require an effort to open and close due to their weight, notwithstanding such rollers. Quite often, older children open such doors to go outside to play, while leaving the doors open. During summer, cool air-conditioned air escapes from the house through such opened sliding doors until an energy-conscious and/or cost-conscious adult notes that the door is open and closes it. During winter months, heated air within the house similarly escapes until the door is closed. As an additional annoyance, bugs and other pests often gain access to a home through such an opened sliding door before the door is again closed. Even adults who must pass through such doors must temporarily leave such doors open, as when the adult has his or her hands full carrying food outdoors to prepare for a family meal.

More importantly, the opened condition of such sliding doors poses a significant hazard in homes where toddlers live. A sliding door left open by an older sibling, or by a forgetful parent may allow an infant or small child to crawl or walk through the opened door and become subject to falling into a swimming pool or other hazard.

The present inventor believes that various efforts have been made in the past to provide a closing mechanism for such sliding doors; for example, it is believed that others have attempted to use extensible coiled springs or elastic cords to return a sliding door to its closed position after being opened and released. However, such coiled springs or elastic cords tend to continuously accelerate the sliding door as it is being closed, sometimes causing the door to impact the door jamb with great force. Apart from the annoyance of the door slamming shut and the excessive wear exerted upon the door components, such systems further pose a significant safety risk to any user who happens to catch his or her fingers in the door as the door is slamming shut.

Apart from such extensible springs and elastic cords, the present inventor also believes that weighted cables have been used by others in the past to close sliding doors. In such systems, a cable extends from the sliding door, over a pulley, to a gravity-actuated weight. As the door is opened, the weight is lifted; when the door is released, the weight lowers and pulls the door closed.

However, such door closure system suffers from some of the same disadvantages as those mentioned above for the springs and elastic cords. Moreover, the requirement for the exposed pulley and weight clearly detracts from the aesthetic appearance of the door.

Accordingly, it is an object of the present invention to provide an apparatus for automatically closing a sliding door which apparatus is compact and unobtrusive.

It is another object of the present invention to provide such a sliding door closing apparatus which is easy to use, requires no adjustments, and operates reliably.

It is still another object of the present invention to provide such a sliding door closing apparatus which automatically closes the door at a safe, controlled speed to avoid slamming the door shut.

It is a further object of the present invention to provide such an automatic sliding door closing apparatus which cushions the door as it approaches the door jamb to avoid injury to fingers or other body parts caught in the door.

It is a still further object of the present invention to provide such a sliding door closing apparatus which is inexpensive to manufacture and easy to install.

Yet another object of the present invention is to provide such a sliding door closing apparatus wherein all of the operative components are mounted above the reach of small children to further avoid any injury.

These and other objects of the present invention will become more apparent to those skilled in the art as the description thereof proceeds.

SUMMARY OF THE INVENTION

Briefly described, and in accordance with a preferred embodiment thereof, the present invention relates to an apparatus for returning a sliding door from an opened position to a closed position, such apparatus including a compressible spring mechanism which extends between first and second opposing ends. The compressible spring mechanism has a first extended length when at rest, but is compressible to assume a shortened length when a compressive force is applied to the first and second ends thereof. When the compressive force is released, the compressible spring mechanism exerts a biasing force tending to move the first and second ends of the compressible spring mechanism apart from each other toward the first extended length.

The sliding door apparatus includes at least a first pulley rotatably supported at or near the first end of the compressible spring mechanism over which a cable may be engaged. The door closing apparatus can include a second pulley supported by the second end of the compressible spring mechanism and movable therewith as the compressible spring mechanism moves between the first extended length and its shortened length positions.

A cable is secured at a first end to the sliding door, and is secured at its opposing second end to the fixed door frame. Preferably, the first end of the cable is secured in a fixed position relative to one of the two ends of the compressible spring mechanism. The aforementioned cable extends about both the first pulley and the second pulley. As the door is opened, tension is applied to the cable, and the first and second pulleys develop a compressive force to shorten the length of the compressible spring mechanism as the door is opened. When the door is released, the compressible spring mechanism returns to its extended length, thereby lengthening the distance between the first and second pulleys, and causing the sliding door to return toward its closed position.

Preferably, the compressive spring mechanism, first pulley, and second pulley are all supported by the sliding door. In this event, the first end of the cable is fixedly secured relative to the jamb of the door, while the first pulley, and first end of the compressible spring mechanism, are fixedly secured to the sliding door. However, the reverse may be the case, and the air spring and pulleys may be mounted to the door jamb, while the cable is anchored to the door.

The compressible spring mechanism extends between its first and second ends along a longitudinal axis; this longitudinal axis is preferably oriented vertically for allowing the compressible spring mechanism and related pulleys to be housed within a vertically-extending side member of the door, or within a tubular housing secured adjacent and parallel to a vertically-extending side member of the door. In the preferred embodiment, the first pulley is secured to the sliding door near its upper end, and the cable is routed from the first pulley to the door jamb along the upper end of the door, whereby all working components are unobtrusive and kept out of reach of the hands of small children.

Within the preferred embodiment of the present invention, the compressible spring mechanism is a gas spring that includes a cylinder and a rod slidingly received within such cylinder. The cylinder of the gas spring contains a pressurized gas which continuously urges the associated rod to an extended position, corresponding to the first extended length position of the compressible spring mechanism. Application of a compressive force to the opposing ends of the compressible spring mechanism causes the rod to retract within the cylinder until the compressive force is released. Ideally, the gas spring includes a piston having an orifice therein secured to the rod and housed within the cylinder for controlling the rate at which the rod may be expelled outwardly from the cylinder. Under dynamic conditions, the orifice meters the flow of gas through the piston as the rod is urged outwardly by the pressurized gas within the cylinder. The piston and related orifice provide a dampening (controlled rate) effect to slow the return of the sliding door from its opened position back to its closed position.

To further avoid the possibility that the door might be slammed shut on a person's fingers, the cylinder may be charged with a small quantity of oil. Before the piston reaches its rest position, the charge of oil must be metered through the aforementioned orifice in the piston. In this manner, the charge of oil within the cylinder serves as a cushion further dampening closing movement of the door as the door approaches the door jamb.

The first pulley and second pulley are preferably part of a block and tackle pulley system over which the cable is threaded. In this manner, relatively small changes in the length of the gas spring produce larger changes in the corresponding distance traveled by the sliding door. The block and tackle pulley system usually includes at least two upper pulleys fixedly supported relative to the upper end of the gas spring and two lower pulleys secured to the lower end of the gas spring for vertical movement therewith. The upper pulleys may share a common axis of rotation, and the lower pulleys may also share a common axis of rotation. These pulley systems may be extended in pairs to increase the length of "throw".

DETAILED DESCRIPTION OF THE PREFERRED EMBODIMENT

Figure 2:
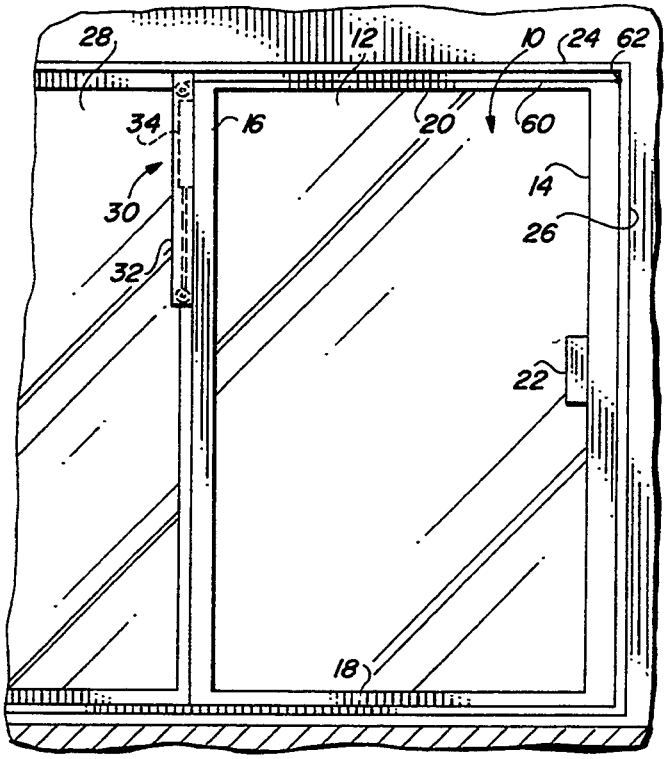
FIG. 2 is a front view of a sliding glass door and surrounding door frame and showing the sliding door closer apparatus of FIG. 1 mounted upon the back of the door, opposite the door jamb.
Figure 3:
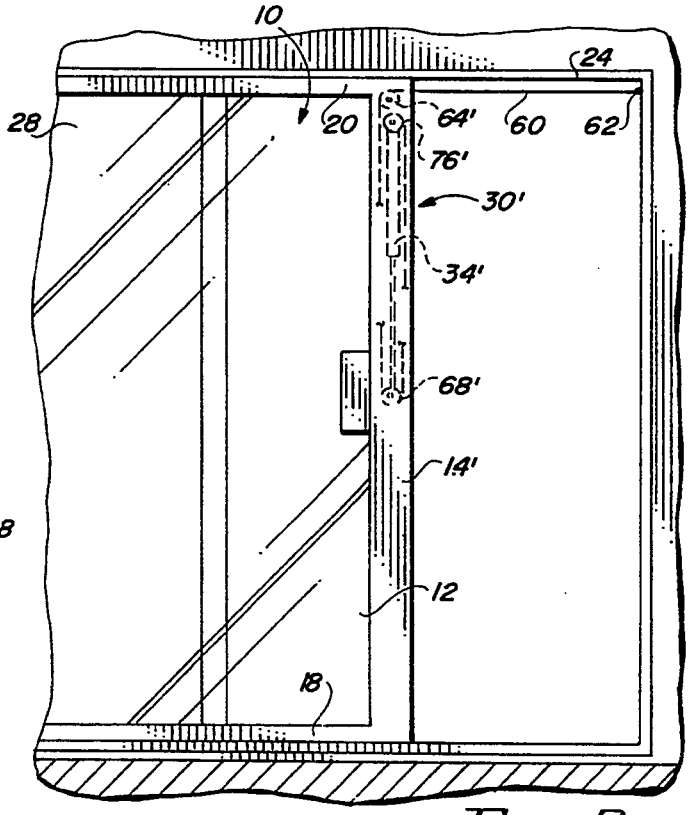
FIG. 3 is a front view of a sliding glass door equipped with an alternate embodiment of the present invention wherein the sliding door closer apparatus is built into the vertical support of the door lying closest to the door jamb.
Figure 8:
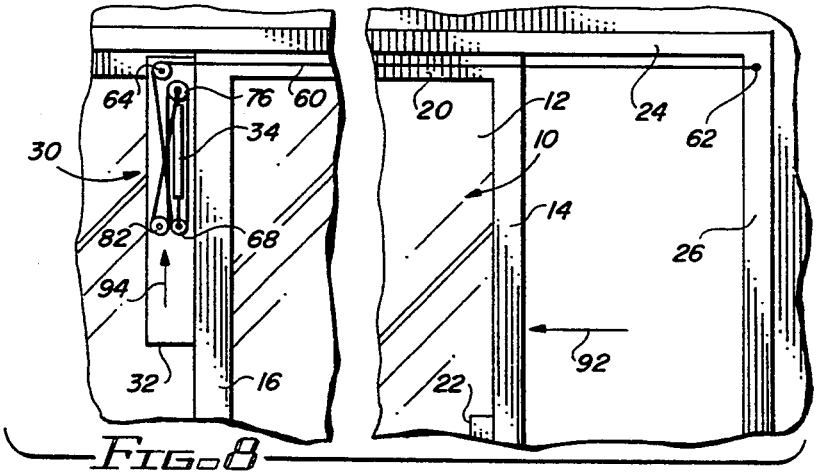
FIG. 8 is a side view of the embodiment of the present invention shown in FIG. 1 using dual upper pulleys and dual lower pulleys, with the sliding door partially opened.

Before describing the preferred embodiments of the sliding door closing apparatus constructed in accordance with the present invention, the basic components of a typical glass sliding door are first described with references to FIGS. 2, 3, and 8. Sliding glass door 10 includes a pane of glass 12 typically measuring approximately six feet eight inches tall by approximately 36 inches wide. Glass pane 12 is supported by a first vertical support 14 and an opposing vertical support 16. Glass pane 12 is further supported by a lower horizontal frame member 18 and an upper horizontal frame member 20. A handle 22 is provided midway along vertical support member 14 to aid a user in sliding the glass door 10 open and closed. A locking mechanism (not shown) may also be provided to keep the door locked.

As shown in FIGS. 2, 3, and 8 sliding glass door 10 is adapted to slide open and closed within a supporting frame 24. Within FIG. 2, sliding glass door is shown in its closed position, with vertical support member 14 nested against door jamb 26. In FIGS. 3 and 8, sliding glass door 10 is shown in a partially opened condition, wherein vertical support member 14' is spaced apart from door jamb 26 for allowing passage through door frame 24. As shown in FIG. 2, a second pane of glass 28 is typically supported adjacent sliding glass door 10 within door frame 24. As shown in FIG. 3, sliding glass door 10 slides past and over fixed glass pane 28 when the door is opened. Suspension rollers (not shown) may be secured to upper frame member 20 for suspending glass door 10 from a roller track within door frame 24. Alternatively, rollers (not shown) may be supported along the bottom of lower frame member 18 for rolling upon a track to facilitate sliding movement of glass door 10.

Figure 1:
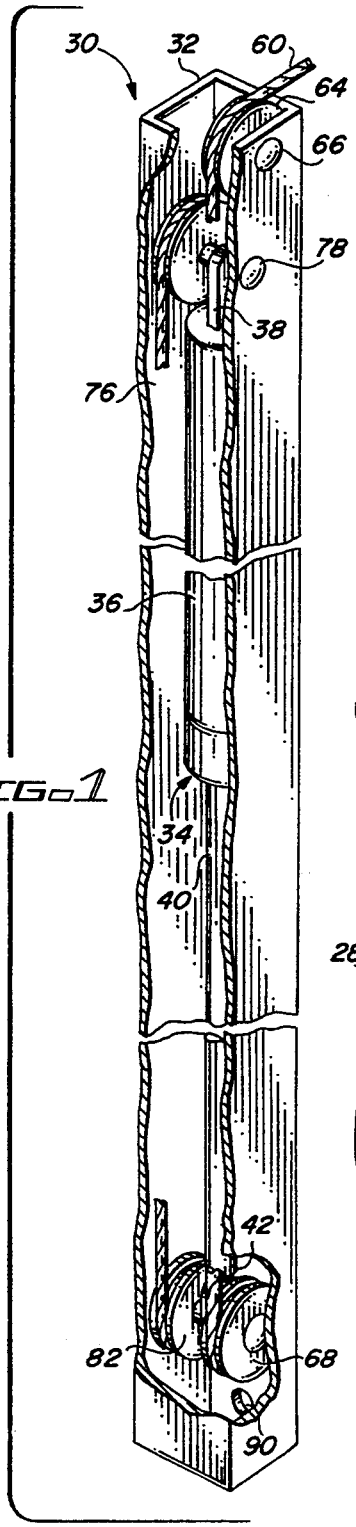
FIG. 1 is a perspective view of a sliding door closing apparatus constructed in accordance with a preferred embodiment of the present invention and illustrating a tubular housing for supporting a gas spring and related block and tackle pulley system.

FIG. 1 illustrates one preferred form of the present invention particularly adapted to be used in conjunction with preexisting sliding glass doors. Within FIG. 1, the closing apparatus is generally designated by reference numeral 30 and includes a section of rectangular tubing 32 measuring approximately $1\frac{1}{2}\times 1$ inch and approximately 24 inches long. Rectangular tubing 32 provides a tubular housing for the components which form closing apparatus 30. Referring briefly to FIG. 2, tubular housing 32 is secured to vertical support 16 of sliding door 10 and extends parallel thereto. The upper end of tubular housing 32 is commensurate with the upper end 20 of sliding glass door 10.

Tubular housing 32 contains a compressible spring mechanism 34, preferably of the type known as a gas spring. Gas spring 34 includes a cylinder 36, the upper end of which terminates in an apertured mounting flange 38. Mounting flange 38 may be considered as a first, or upper, end, of gas spring 34. Extending from the lower portion of cylinder 36 is a retractable/extensible elongated rod 40. The upper end of rod 40 is slidingly received within cylinder 36; the opposing lower end of rod 40 terminates in an apertured mounting flange 42. The lower end of rod 40 may be considered a second end of gas spring 34. Cylinder 36 and rod 40 of gas spring 34 extend substantially along a common longitudinal axis between upper mounting flange 38 and lower mounting flange 42.

Gas spring 34 may be considered as a mechanical equivalent of a dampened compressible spring. Within FIGS. 1 and 2, gas spring 34 is shown in its rest position with rod 40 fully extended from cylinder 36. When a compressive force is applied between upper mounting flange 38 and lower mounting flange 42 of gas spring 34, rod 40 retracts within cylinder 36. When rod 40 is retracted within cylinder 36, gas spring 34 assumes a shortened length, i.e., the distance between upper mounting flange 38 and lower mounting flange 42 is shorter than the extended length between such points when gas spring 34 is at rest. When such compressive force is released, gas spring 34 exerts a biasing force downwardly upon rod 40 until rod 40 is once again fully extended.

Figure 5:
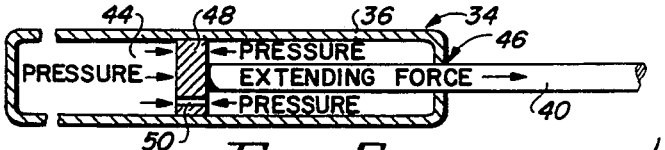
FIG. 5 is a simplified sectional view of the interior of the gas spring showing the cylinder, rod, and apertured piston for controlling the rate at which the sliding door is closed.

Gas springs of the type described above with reference to FIG. 1 are commercially available from Gas Spring Company, a division of Fichtel & Sachs Industries, Inc., of Colmar, Pa. Such gas springs are commonly used in applications requiring controlled lifting, lowering, and counterbalancing, and are most familiar within automotive applications for supporting automobile hoods and trunk lids. Referring briefly to FIG. 5, cylinder 36 contains a pressurized inert gas inside the interior 44 of cylinder 36. As the pressure of the inert gas within cylinder 36 is greater than atmospheric pressure, the pressurized inert gas exerts a biasing force tending to extend rod 40 from cylinder 36. A hermetic seal 46 allows rod 40 to slide within cylinder 36 without releasing pressure therefrom.

Still referring to FIG. 5, a piston 48 is secured to the interior end of rod 40 for wipingly engaging the interior walls of cylinder 36. A small orifice 50 extends through piston 48 connecting the two faces of piston 48. Cylinder 36 preferably includes a charge of non-compressible oil in addition to the pressurized inert gas. As rod 40 is extended out of cylinder 36, the gas and oil within the rightmost portion of cylinder 36, as shown in FIG. 5, must be metered into the leftmost portion of cylinder 36, through orifice 50, in order to permit rod 40 to be fully extended. The rate at which rod 40 is extended from cylinder 36 may be controlled by properly selecting the size of orifice 50. Thus, gas spring 34 serves to dampen the force exerted by rod 40 at a relatively uniform and controlled rate of extension.

Moreover, when gas spring 34 extends vertically with rod 40 extending from the lower portion of cylinder 36, as shown in FIG. 2, the oil charge within cylinder 36 falls under the force of gravity to the lowermost portion of cylinder 36 when rod 40 is retracted. When the compressive force is released, and rod 40 is permitted to extend, the initial rate of extension is controlled at the rate at which pressurized gas is transferred through orifice 50, since the oil remains near the bottom end of cylinder 36. Only as rod 40 reaches a point near its full extension does the thicker oil begin to pass through orifice 50. Thus, the final extension of rod 40 from cylinder 36 is cushioned by the oil for further decreasing the rate at which rod 40 is extended.

The present inventor has found that one such gas spring which works particularly well for the present application is commercially available from Spring Lift Corporation of Montecello, Ark. under part no. SL3-20; this gas spring is relatively compact and has a first extended length of approximately 20 inches at rest, and approximately a 12 inch length when the extensible rod is fully retracted.

Referring again to FIGS. 1 and 2, a cable 60 is shown having a first end secured to door jamb 26 at an anchor point 62. Cable 60 is shown within FIG. 2 extending horizontally along the upper portion of door frame 24 until reaching vertical support member 16 of sliding door 10. As shown in FIG. 1, cable 60 then passes over a first pulley 64 that is rotatably secured to the upper end of tubular housing 32 by an axle 66 proximate the upper end 38 of gas spring 34. Cable 60 may be made of inexpensive nylon rope; preferably, cable 60 is a plastic-coated steel aircraft cable for strength and long life. Pulley 64 is preferably formed of a nylon material commercially available under the brand name "Delrin"; such material is strong, lightweight, and quiet in operation.

Figure 4:
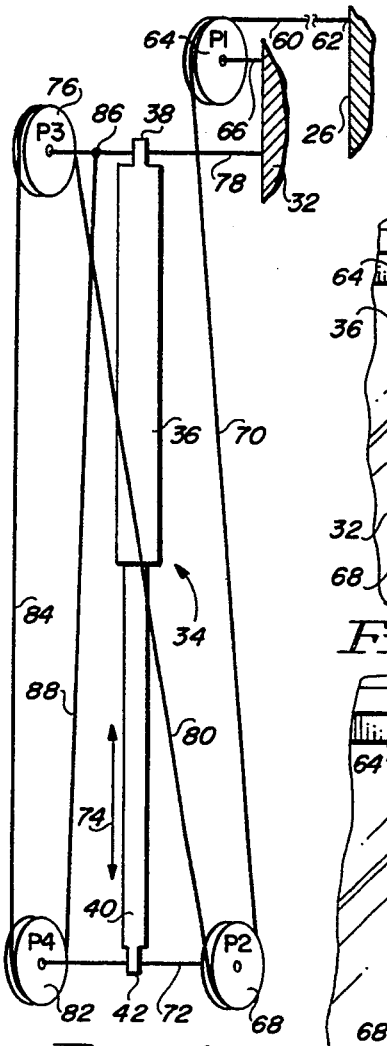
FIG. 4 is a schematic drawing of the gas spring and related block and tackle pulley system shown in FIG. 1.

Referring jointly to FIG. 1 and the schematic of FIG. 4, cable 60 passes over pulley 64 and extends downwardly to a second pulley 68. Within FIG. 4, the portion of cable 60 extending between pulley 64 and pulley 68 is designated by reference numeral 70. Pulley 68 is rotatably supported upon an axle 72, the shaft of which also passes through the apertured mounting flange 42 of extensible rod 40. Thus, second pulley 68 is supported by the second end of gas spring 34 for vertical movement therewith, as indicated by arrow 74 within FIG. 4.

After engaging second pulley 68, cable 60 extends upwardly to pass over a third pulley 76. Pulley 76 is rotatably supported by an axle 78 secured to tubular housing 32. In addition, the shaft of axle 78 passes through the upper mounting tab 38 of cylinder 36. The portion of cable 60 extending upwardly from second pulley 68 to third pulley 76 is designated by reference numeral 80 within FIG. 4.

For purposes of clarification in the drawings, first pulley 64 and third pulley 76 are shown as being supported by separate axles 66 and 78, respectively. However, those skilled in the art will appreciate that pulleys 64 and 76 may be coaxial, whereby a single support axle passes through support housing 32, through first pulley 64, through upper mounting bracket 38, and through third pulley 76.

After passing over third pulley 76, cable 60 extends downwardly to engage a fourth pulley 82. As shown in FIGS. 1 and 4, fourth pulley 82 may share a common support axle 72 with second pulley 68. Like second pulley 68, fourth pulley 82 is secured to the lower mounting flange of rod 40 for vertical movement therewith within tubular housing 32. The portion of cable 60 extending between third pulley 76 and fourth pulley 82 is designated within FIG. 4 by reference numeral 84. From fourth pulley 82, cable 60 continues upwardly to its opposing second end which, as shown in FIG. 4, may be anchored to fixed axle 78 at anchor point 86. The portion of cable 60 extending between fourth pulley 82 and anchor point 86 is designated within FIG. 4 by reference numeral 88.

Installation of closing device 30 is relatively easy. Referring to FIG. 1, a mounting hole 90 is provided near the lower end of tubular housing 32 within the wall thereof that lies adjacent vertical support member 16 of sliding door 10. Near the upper end of tubular housing 32, an alignment pin (not shown) extends from the same wall for engaging a centering hole drilled within vertical support 16 near the upper end thereof. A self-tapping screw (not shown) may then be inserted through hole 90 and screwed into vertical support 16. Tension within cable 60 will maintain the aforementioned alignment pin in engagement with the centering hole drilled within vertical support 16. Cable 60 is pulled taut and anchored at anchor point 62 shown in FIG. 2, in order to complete the installation.

In operation, a user opens sliding door 10, as indicated within FIG. 8 by arrow 92. As sliding door 10 advances towards the left, the tightening of cable 60 about pulleys 64, 68, 76, and 82 applies a compressive force to the opposing ends of gas spring 34, shortening the length thereof, as indicated by arrow 94 within FIG. 8. On the other hand when the user releases sliding door 10, gas spring 34 urges pulleys 68 and 82 downward toward the fully extended position, thereby causing sliding door 10 to slide toward door jamb 26. For the reasons explained above, gas spring 34 extends rod 40 at a controlled rate thereby preventing sliding door 10 from slamming shut against door jamb 26. Furthermore, as vertical support 14 of sliding door 10 approaches door jamb 26, the oil cushion within gas spring 34 slows the advance of the door even further to prevent pinching a person's fingers between vertical support 14 and door jamb 26.

One of the primary advantages of the present invention is the displacement advantage obtained by using a block and tackle pulley arrangement in conjunction with gas spring 34. Referring FIG. 4, pulleys 64, 68, 76, and 82 together form a block and tackle pulley system. Cable 60 passes back and forth between the opposing ends 38 and 42 of gas spring 34 four different times corresponding to cable sections 70, 80, 84, and 88. Thus, for each one-inch displacement of extensible rod 40, cable 60 moves four inches. Thus, even if sliding door 10 must be allowed to travel 32 inches to fully open, extensible rod 40 need only travel 8 inches when retracting as the door is opened. Accordingly, this displacement advantage allows closing device 30 to be packaged as a compact, unobtrusive system while remaining operative to fully close the door from a fully opened position.

Figure 6:
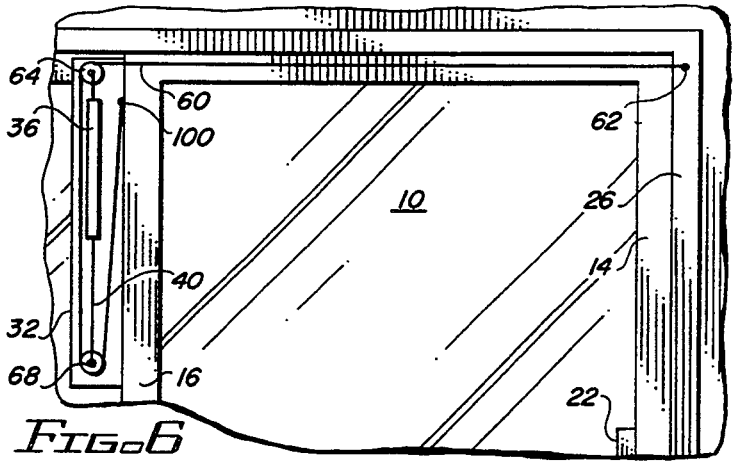
FIG. 6 is a side view of an embodiment of the present invention using a single upper pulley and a single lower pulley.

While the preferred embodiment of the present invention uses four pulleys, as shown in FIGS. 1, 4, and 8, other embodiments of the present invention using only two pulleys or any other number of pulleys may also be used. For example, within FIG. 6, an alternate embodiment of the present invention is illustrated, wherein like reference numerals designate similar components. Within FIG. 6, only a first upper pulley 64 and second lower pulley 68 are used. As before, pulley 64 is fixedly secured to tubular housing 32 approximately at the upper end thereof for allowing cable 60 to pass thereover. As before, second pulley 68 is rotatably secured to the lower end of extensible rod 40 for vertical movement therewith. Cable 60 terminates at an anchor point 100 which, if desired, may be coaxial with the axis of first pulley 64. In this embodiment, a much longer air spring must be used, since a 30 inch travel of door 10 results in a 15 inch travel of extensible rod 40.

Figure 7:
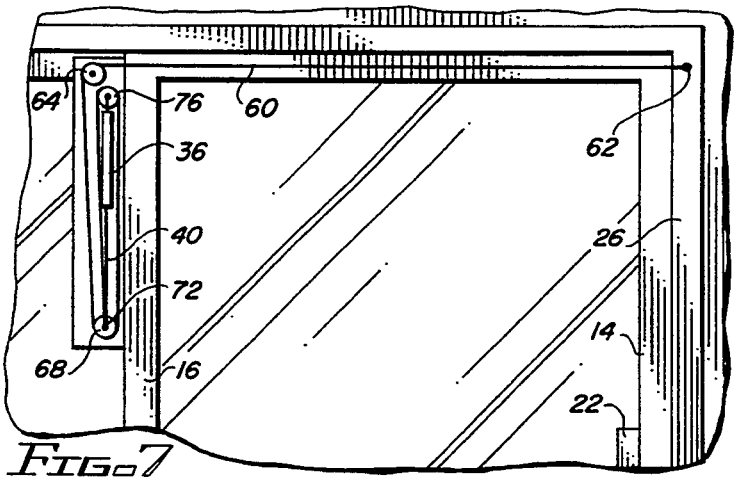
FIG. 7 is a side view of an embodiment of the present invention using dual upper pulleys and a single lower pulley.

FIG. 7 illustrates another embodiment of the present invention using a three pulley system. As before, cable 60 passes over first pulley 64 and around a second pulley 68. Cable 60 then passes upwardly around a third pulley 76 and back down to anchor point 72, which may be coaxial with pulley 68. Within the pulley system shown in FIG. 7, ribbon cable 60 passes back and forth along the air spring three times, thereby providing a three times displacement factor. Accordingly, a 30 inch travel of the sliding door requires only a 10 inch travel for extensible rod 40.

Returning to FIG. 3, a further embodiment of the present invention is illustrated wherein the sliding door closing apparatus is incorporated within a vertical support member of the door itself. This embodiment of the present invention lends itself more to newly manufactured sliding doors than to preexisting sliding doors. Within FIG. 3, vertical support member 14' is hollow. Air spring 34' is housed within vertical support member 14' and extends parallel therewith. Also housed within vertical support member 14' is a first pulley 64' for receiving cable 60, a first end of which is anchored at anchor point 62 to door jamb 26. A hole is drilled within vertical support 14' for allowing cable 60 to pass therein. Second, third, and fourth pulleys 68', 76', and 82', respectively, are also housed within vertical support 14' in a manner similar to that described for tubular housing 32 relative to FIG. 1. The manner of operation of closing apparatus 30' shown in FIG. 3 is identical to that described above with reference to FIGS. 1 and 2, except that closing apparatus 30' is entirely self-contained within vertical support 14' of sliding door 10.

Those skilled in the art will now appreciate that a compact and reliable closing device has been described for safely closing sliding glass doors automatically after they are opened. The air spring mechanism incorporated within such closing device assures that the door will close at a controlled, safe speed, without slamming shut. It will also be appreciated that the oil charge, and vertical orientation, of the air spring provides a cushion which further slows the closing of the door as the door is about to contact the door jamb. The door closing mechanism described above is inexpensive to manufacture and easy to install with both newly manufactured doors and preexisting sliding doors.

While the present invention has been described with reference to several preferred embodiments thereof, the description is for illustrative purposes only and should not be construed as limiting the scope of the invention. For example, while the present invention has been described for use with sliding glass doors, the above-described closing apparatus may also be used in conjunction with sliding window panels. In addition, such closing apparatus may also be used with other types of sliding doors, such as those provided upon walk-in freezers and the like. Various modifications and changes may occur to those skilled in the art without departing from the true spirit and scope of the invention, as defined by the appended claims.

I claim:

1. Apparatus for returning a sliding door from an opened position to a closed position, the sliding door sliding within a frame, the frame including a jamb against which the sliding door rests in its closed position, the sliding door being spaced apart from the jamb when in its opened position, said apparatus comprising in combination:

a. compressible spring means extending along a longitudinal axis between first and second opposing ends thereof, said compressible spring means having a first extended length when at rest and being compressible to assume a shortened length when a compressive force is applied between the first and second ends thereof, said compressible spring means exerting a biasing force tending to move the first and second ends thereof apart from one another toward said first extended length when the compressive force is released;

b. a cable;

c. first pulley means supported proximate the first end of said compressible spring means for rotatably supporting said cable;

d. second pulley means supported by the second end of said compressible spring means for rotatably supporting said cable, said second pulley means being movable with the second end of said compressible spring means as said compressible spring means moves between its first extended length and its shortened length, said cable extending about second pulley means; and e. said cable extending between first and second opposing ends, the first end of said cable being fixedly secured relative to the door frame and the second end of said cable being fixedly secured relative to one of the first and second ends of said compressible spring means, said cable extending about said first pulley means;

wherein the opening of the door applies a compressive force to said compressible spring means and causes said compressible spring means to move from the first extended length toward the shortened length, and wherein the release of the door releases such compressive force and permits said compressible spring means to return to its extended length, thereby sliding the door back to its closed position.

2. The apparatus recited by claim 1 wherein the first end of said cable is fixedly secured relative to the jamb of the door and wherein said first pulley means is fixedly secured relative to the sliding door.

3. The apparatus recited by claim 1 wherein the longitudinal axis of said compressible spring means extends substantially vertical.

4. The apparatus recited by claim 3 wherein the sliding door includes a first side lying adjacent the jamb when the door is closed and an opposing second side, said compressible spring means extending proximate and parallel to the second side of the sliding door.

5. The apparatus recited by claim 4 wherein the sliding door includes opposing upper and lower ends, said first pulley means being secured proximate the upper end of the sliding door.

6. The apparatus recited by claim 3 wherein the sliding door includes a first side lying adjacent the jamb when the door is closed and an opposing second side, said compressible spring means being housed within the first side of the sliding door.

7. The apparatus recited by claim 6 wherein the sliding door includes opposing upper and lower ends, said first pulley means being secured proximate the upper end of the door.

8. The apparatus recited by claim 1 including dampening means for dampening said compressive spring means to slow the return of the sliding door from its opened position to its closed position at a controlled rate.

9. The apparatus recited by claim 8 including cushioning means for further decreasing the rate at which the sliding door can further advance toward the jamb as the sliding door approaches the jamb.

10. The apparatus recited by claim 1 wherein said compressible spring means comprises a gas spring including a cylinder and a rod slidingly received thereby, said gas spring containing a pressurized gas for urging said rod to an extended position corresponding to said first extended length of said compressible spring means, said rod sliding into said cylinder when a compressive force is applied thereto corresponding to said shortened length of said compressible spring means.

11. The apparatus recited by claim 10 wherein said gas spring includes a piston secured to said rod within said cylinder, said piston having an orifice therein through which said pressurized gas may pass at a controlled rate, said piston and orifice dampening said compressive spring means to slow the return of the sliding door from its opened position to its closed position at a controlled rate.

12. The apparatus recited by claim 11 wherein said cylinder contains oil, and wherein said piston meters said oil through the orifice therein as said rod approaches its extended position, said oil serving as a cushion by further decreasing the rate at which the sliding door can fully advance toward the jamb as the sliding door approaches the jamb.

13. The apparatus recited by claim 11 wherein the sliding door includes a first side lying adjacent the jamb when the door is closed and an opposing second side, said apparatus further including a tubular housing extending proximate and parallel to the second side of the sliding door and secured thereto, said gas spring extending within said tubular housing, and said cable extending from said tubular housing along the upper end of the door, the first end of said cable being secured to the upper end of the jamb.

14. The apparatus recited by claim 13 wherein the sliding door includes opposing upper and lower ends, said first pulley means being secured proximate the upper end of the sliding door.

15. The apparatus recited by claim 1 wherein said first pulley means and said second pulley means collectively form a block and tackle about which said cable is engaged.

16. The apparatus recited by claim 15 wherein said first pulley means includes at least two pulleys and wherein said second pulley means includes at least one pulley.

17. The apparatus recited by claim 15 wherein said first pulley means includes at least two pulleys and wherein said second pulley means includes at least two pulleys.

18. The apparatus recited by claim 17 wherein said at least two pulleys of said second pulley means have a common axis of rotation.

19. The apparatus recited by claim 15 wherein said first pulley means and said second pulley means include a like number of pulleys.

* * * * *